US008535176B2

(12) United States Patent
Bazzel et al.

(10) Patent No.: US 8,535,176 B2
(45) Date of Patent: Sep. 17, 2013

(54) GOLF CLUB SET

(75) Inventors: Brian Bazzel, Carlsbad, CA (US); Marni D. Ines, San Marcos, CA (US); Sean Toulon, Vista, CA (US); Bret H. Wahl, Escondido, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 290 days.

(21) Appl. No.: 12/980,238

(22) Filed: Dec. 28, 2010

(65) Prior Publication Data

US 2011/0159981 A1 Jun. 30, 2011

Related U.S. Application Data

(60) Provisional application No. 61/291,294, filed on Dec. 30, 2009.

(51) Int. Cl.
*A63B 53/04* (2006.01)

(52) U.S. Cl.
USPC ..... 473/345; 473/290; 473/350

(58) Field of Classification Search
USPC ..... 473/290–291, 345–346, 350
See application file for complete search history.

(56) References Cited

U.S. PATENT DOCUMENTS

| | | | | |
|---|---|---|---|---|
| 4,645,207 | A * | 2/1987 | Teramoto et al. | 473/290 |
| 4,887,815 | A * | 12/1989 | Hughes et al. | 473/291 |
| 5,429,353 | A * | 7/1995 | Hoeflich | 473/350 |
| 6,106,410 | A * | 8/2000 | Glod et al. | 473/290 |
| 7,137,903 | B2 * | 11/2006 | Best et al. | 473/290 |
| 7,186,188 | B2 | 3/2007 | Gilbert et al. | |
| 7,235,023 | B2 * | 6/2007 | Sugimoto | 473/291 |
| 7,803,062 | B2 * | 9/2010 | Gilbert et al. | 473/290 |
| 7,892,106 | B2 * | 2/2011 | Matsunaga | 473/290 |
| 2004/0224785 | A1 * | 11/2004 | Hasebe | 473/287 |
| 2010/0048322 | A1 * | 2/2010 | Sugawara et al. | 473/342 |

* cited by examiner

*Primary Examiner* — Stephen L. Blau
(74) *Attorney, Agent, or Firm* — Klarquist Sparkman, LLP

(57) ABSTRACT

Golf club irons having improved forgiveness, playability and performance characteristics are disclosed. The embodiments set forth parameters of various irons that affect performance either alone or in combination with other parameters when the irons are utilized to strike a golf ball. The parameters, which in some cases may be systematically progressed or varied, include golf club shaft length, striking face area, loft, coefficient of restitution, face thickness, topline thickness, swing weight, sole width at the heel and toe, and other performance characteristics.

4 Claims, 3 Drawing Sheets

GOLF CLUB SET

CROSS REFERENCE TO RELATED APPLICATION

This application is a non-provisional application claiming priority to and benefit of provisional U.S. Patent Application No. 61/291,294, filed Dec. 30, 2009, which is incorporated herein by reference.

FIELD

The present application concerns golf club irons designed to increase forgiveness, playability and performance.

BACKGROUND

Golf is a game in which a player, using many types of clubs, hits a ball into each hole on a golf course in the lowest possible number of strokes. Golf club manufacturers and designers seek to improve certain performance characteristics such as forgiveness, playability, feel, and sound. In addition, in sets of golf clubs, such as sets of irons, continuity of the performance characteristics within the set may be desirable. Golfers prefer golf clubs that exhibit performance characteristics such as forgiveness, performance and playability. One measure of "forgiveness" can be defined as the ability of a golf club to reduce the effects of mis-hits, e.g., hits resulting from striking the golf ball at a less than ideal impact location and manner on the golf club head. Greater forgiveness of the golf club generally equates to a higher probability of hitting a straight golf shot. "Playability" can be defined as the ease with which a golfer can use the golf club iron for producing accurate golf shots. Better performance of a set of irons can be defined to include, among other things, increased peak trajectory, ball speed and distance, and/or shot precision.

Thus, there exists a need for a set of irons that improves at least the forgiveness and playability characteristics to provide a golfer with improved performance, consistency, and confidence.

SUMMARY

The present application concerns golf club irons designed to increase forgiveness, playability and performance. In one embodiment, the irons have substantially larger and consistent face areas but progressively thinner face thicknesses from the wedges or shorter irons to the longer irons. In another aspect, the irons have uniquely wide sole widths or dimensions. In yet another aspect, the shaft lengths are uniquely and progressively longer from the wedges or shorter irons to the longer irons. These parameters and their overall systematic and unique progressions or variations work individually and together with one or more other parameters to improve forgiveness, playability, and performance.

For instance, in one embodiment, the golf set includes ten irons (specifically, 3-iron to 9-iron, PW, AW, and SW) and each iron has a face area greater than 3100 $mm^2$. The long irons (i.e., 3-, 4-, and 5-irons) have a face thickness of about 1.9 mm, the middle irons (i.e., 6- and 7-irons) have a face thickness of about 2.2 mm, and the short irons and wedges (i.e., 8- and 9-irons and PW, AW, and SW) have a face thickness of about 2.5 mm. In another embodiment, the 3- through 9-irons have substantially the same size face area that is greater than about 3100 $mm^2$, and preferably about 3150 $mm^2$. In other embodiments, the irons have substantially wide sole widths in order to allow (among other things) weight to be distributed lower and farther back from the club's face. The embodiments disclosed herein provide, among other things, irons with higher coefficients of restitution (COR), which in some embodiments is greater than about 0.800 (when tested as set forth herein).

In some embodiments, the topline thicknesses of the long irons are about 9.3 mm to about 9.4 mm, those of the middle irons are about 8.5 mm, and those of the short irons and wedges are about 7.5 mm to about 7.7 mm. In other embodiments, the 3-iron has a shaft length of about 38.0 inches or greater, and preferably 38.6 inches, and the 4-iron and 5-iron each have a shaft length of about 37.0 inches or greater, and preferably 37.9 and 37.3 inches, respectfully.

It should be understood and appreciated that the parameters and unique variations of the irons provide increased club head speed, ball launch angles, higher peak trajectory, and ball speed and distance. As such, the irons allow for more forgiveness and playability for golfers of all abilities.

The foregoing objects, features, and advantages of the golf club set are not intended to be limiting and will become more apparent from the following detailed description, which proceeds with reference to the accompanying figures.

BRIEF DESCRIPTION OF THE DRAWINGS

The claimed subject matter is illustrated by way of example and not limitation in the figures of the accompanying drawings in which like references indicate similar elements.

DETAILED DESCRIPTION

Various embodiments and aspects of the golf club irons will be described with reference to details discussed below, and the accompanying drawings will illustrate the various embodiments. Numerous specific details are described to provide a thorough understanding of various embodiments of the claimed subject matter. However, in certain instances, well-known or conventional details are not described in order to provide a concise discussion of embodiments of the claimed subject matter. In view of the many possible embodiments to which the principles may be applied, it should be recognized that the illustrated embodiments are only preferred examples of the golf club irons disclosed herein and should not be taken as limiting the scope of the claimed subject matter. It will be evident that various modifications may be made thereto without departing from the broader spirit and scope as set forth herein. The specification and drawings are, accordingly, to be regarded in an illustrative sense rather than a restrictive sense.

Embodiments of a golf club set may include performance characteristics that may have a particular progression and/or continuity, meaning, for example, that individual clubs within the set may have particular characteristics that vary as compared to other clubs within the set. In one embodiment, a golf club set may include a plurality of golf club irons. A standard set may include approximately 8 irons, numbered from 3-pitching wedge (PW), although less or more than 8 irons may comprise a set, and embodiments of the claimed subject matter are not limited in this respect. For example, in one embodiment an iron set may include 10 irons, comprising 3-PW, A-wedge (AW) and sand wedge (SW).

A typical set of irons may not take into account the needs of individual golfers, but, generally speaking, tend to be designed to have a standard progression of performance characteristics. As a result, one set of golf club irons may not perform well for all golfers. It may not be practical for each golfer to customize a set of irons, as this may be cost prohibitive.

Performance characteristics may include characteristics that may affect performance of a golf club when utilized to strike a golf ball. In particular embodiments, performance characteristics may include golf club shaft length, golf club striking face area, golf club loft, golf club coefficient of restitution, golf club face thickness, golf club topline thickness, golf club cavity volume if the golf club has a cavity, golf club swing weight, golf club sole width at the heel and/or at the toe, and other performance characteristics. One or more of these performance characteristics may be determined by particular methods, including one or more methods as set forth by current United States Golf Association (USGA) regulations.

Figure 1A:
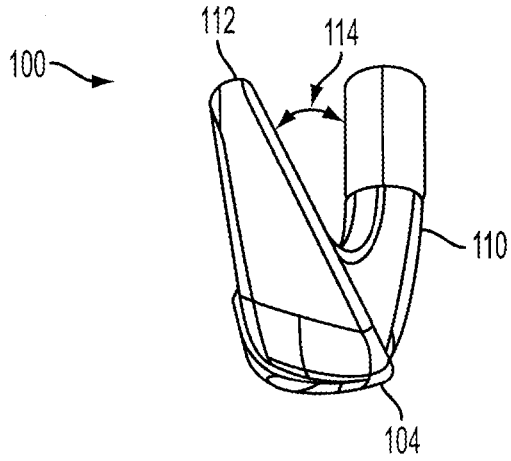
FIG. 1A is a toe-ward view of an embodiment of a golf club head.
Figure 1B:
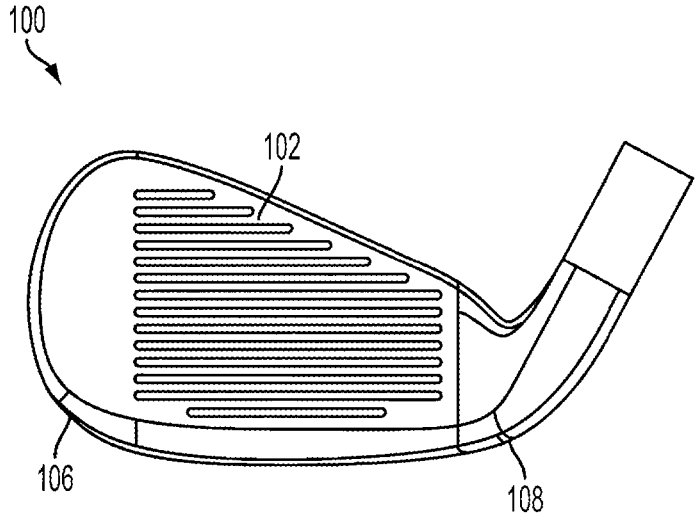
FIG. 1B is a face view of an embodiment of a golf club head.

FIGS. 1A and 1B illustrate a golf club iron head. Illustrated in FIGS. 1A and 1B is a golf club head 100, which is an iron golf club head. Golf club head 100 has a face 102, which has a particular face area and a particular face thickness. Golf club head 100 includes a toe 106 and a heel 108. Golf club head 100 includes a sole 104 having a width. The sole width may vary between the toe 106 and the heel 108, although in other embodiments the sole width may not vary. Golf club head 100 includes a hosel offset 110 and a loft 114. Golf club head 100 also includes a topline 112 having a thickness. The topline thickness may vary along the top surface of golf club head 100, although in other embodiments the topline thickness may not vary. Additionally, golf club head 100 may have a particular COR, and when assembled into a golf club may have a particular swing weight. Also, golf club head 100 may comprise a cavity back type of golf club head, and the cavity of the cavity back may have a particular cavity volume.

As mentioned previously, one or more of these characteristics may vary between golf club heads within a set. Some characteristics may vary more than others, and the characteristics may follow a linear progression or a non-linear progression. As just an example, in one embodiment the following characteristics may vary between the golf club heads within a set: shaft length; topline thickness; face area; cavity volume; swing weight; sole width at heel and toe; face thickness; loft; and COR. However, as noted previously, the scope of the claimed subject matter is not limited to just these characteristics, and may include other performance characteristics not listed in detail.

Figure 2A:
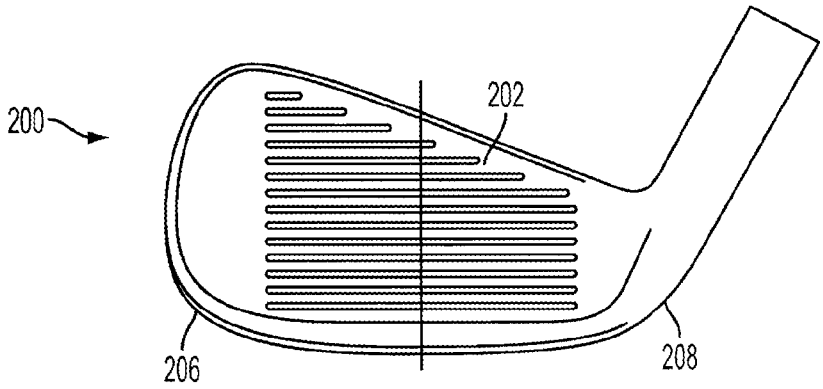
FIG. 2A is a face view of an embodiment of a golf club head.
Figure 2B:
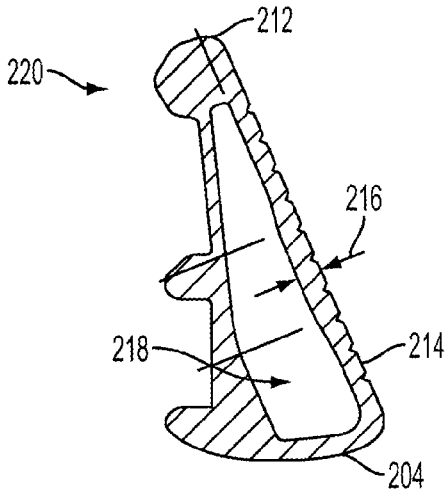
FIG. 2B is a cross-sectional view of an embodiment of a golf club head.
Figure 2C:
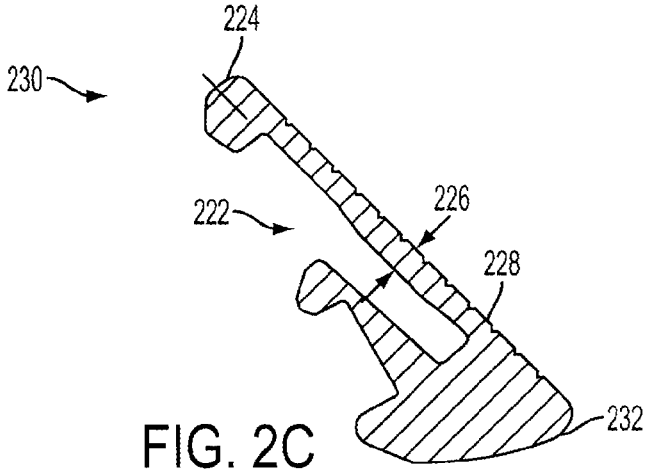
FIG. 2C is a cross-sectional view of an embodiment of a golf club head.

Referring now to FIGS. 2A, 2B and 2C, there are illustrated multiple golf club heads. Illustrated in FIG. 2A is a golf club head 200, which is an iron golf club head. Golf club head 200 has a face 202, which has a particular face area and a particular face thickness. Golf club head 200 includes a toe 206 and a heel 208. Illustrated in FIG. 2B is a golf club head 220. Golf club head 220 includes a sole 204 having a width. The sole width may vary between the toe area and the heel area, although in other embodiments the sole width may not vary. Golf club head 220 includes a topline 212 having a thickness. The topline thickness may vary along the top surface of golf club head 220, although in other embodiments the topline thickness may not vary. Additionally, golf club head 220 may have a particular COR, and when assembled into a golf club may have a particular swing weight. Golf club head 220 includes a face 214 having a thickness 216. Furthermore, golf club head 220 comprises a hollow area 218. As will be explained later, hollow area 218 may be filled with materials including polymer and/or foam, and when included as part of a golf club set, the hollow area as well as the filler materials may vary from club to club. Illustrated in FIG. 2C is a golf club head 230. Golf club head 230 includes a sole 232 having a width. The sole width may vary between the toe area and the heel area, although in other embodiments the sole width may not vary. Golf club head 230 includes a topline 224 having a thickness. The topline thickness may vary along the top surface of golf club head 230, although in other embodiments the topline thickness may not vary. Additionally, golf club head 230 may have a particular COR, and when assembled into a golf club may have a particular swing weight. Golf club head 230 includes a face 228 having a thickness 226. Furthermore, golf club head 230 comprises a cavity back area 222 having a particular volume. As will be explained later, when included as part of a golf club set, cavity back area 222 may vary in shape and/or volume from club to club within the set.

Figure 3:
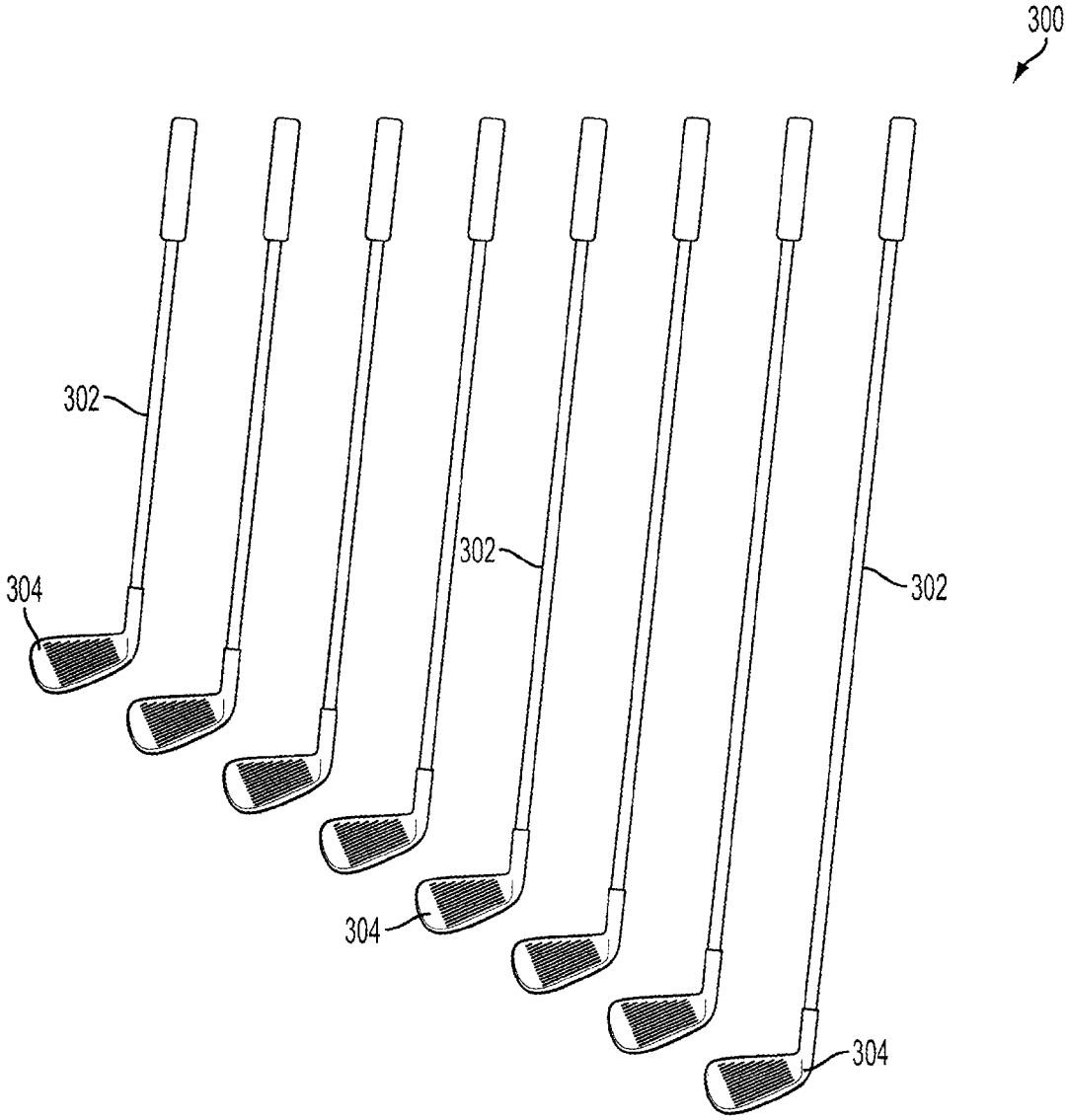
FIG. 3 illustrates one embodiment of a golf club set.

Referring now to FIG. 3, there is illustrated a golf club set 300. Golf club set 300 may include one or more types of golf club heads 304, including cavity back, muscleback, blades, hollow clubs or other types of club heads typically used as part of a set. Golf club set 300 may have varying performance characteristics between clubs. For example, shafts 302 may vary in length, swing weight may vary, and one or more of the performance characteristics noted above may vary. As one example, at least a portion of the golf clubs of set 300 may include hollow clubs. Individual hollow clubs may include hollow areas that vary in volume. Furthermore, hollow areas may be filled with foam, polymer or other types of materials, and the particular type of filler materials may vary from club to club. Additionally, the club types within set 300 may vary, such as by including some hollow clubs, some cavity back clubs and some muscleback clubs within one set.

Table 1 illustrates one particular preferred embodiment of a golf club set having performance characteristics that vary between clubs within the set. However, it is worthwhile to note that this is just one embodiment and the claimed subject matter is not limited in this respect.

TABLE 1

| Iron # | 3 | 4 | 5 | 6 | 7 | 8 | 9 | PW | AW | SW |
|---|---|---|---|---|---|---|---|---|---|---|
| Shaft length (inches) | 38.6 | 37.9 | 37.3 | 36.7 | 36.0 | 35.5 | 35.1 | 34.5 | 34.5 | 34.3 |
| Topline thickness (mm) | 9.4 | 9.3 | 9.4 | 8.5 | 8.5 | 7.6 | 7.6 | 7.5 | 7.5 | 7.7 |
| Face Area ($mm^2$) | 3152 | 3152 | 3152 | 3152 | 3152 | 3154 | 3150 | 3166 | 3207 | 3348 |
| Swing Weight | D3.5 | D3.5 | D3.5 | D3.5 | D3.5 | D3.5 | D3.5 | D3.5 | D3.5 | D5.0 |
| Sole Width, toe (mm) | 25.5 | 26.1 | 26.5 | 24.9 | 25.2 | 23.4 | 23.8 | 23.8 | 24.8 | 26.0 |
| Sole Width, heel (mm) | 17.5 | 17.9 | 18.4 | 18.4 | 19.0 | 18.1 | 18.5 | 19.0 | 19.3 | 21.3 |
| Face thickness, base (mm) | 1.9 | 1.9 | 1.9 | 2.2 | 2.2 | 2.5 | 2.5 | 2.5 | 2.5 | 2.5 |
| Loft (degrees) | 19 | 21 | 24 | 27 | 31 | 35 | 40 | 45 | 50 | 55 |
| COR measured | | .819 | | .807 | | | | | | |

As reflected in Table 1, there is a unique progression in increased shaft lengths from the SW to the 3-iron. (It should be understood that the golf club set may have fewer or more irons as set forth in Table 1.) A club head's speed (as the club is swung) correspondingly increases with an increase in the club's shaft length. Greater club head speed equals greater ball speed and hence distance. It is generally preferable to achieve a consistent average gapping distance from club to club. In this way, the golfer is provided with a full range of consistent and increasing club shot distances so that the golfer can select a club or iron for the distance required by a particular shot or situation. Typically, the average gapping distance from club to club in a set of irons for an average player is about 8-10 yards. As set forth herein, the uniquely increased shaft lengths from the SW to the 3-iron help provide for an average gapping distance for an average player of about 11-15 yards from club to club, respectively. In this respect, the embodiments herein provide consistency as well as an overall greater range of distances for the golfer.

The overall increase in shaft length from the SW to the PW is about 0.2 inches. As such, the increase in club head speed from the SW to the PW is not as substantial as each club is similarly swung. However, other physical parameters of the wedges, including for instance the degree of loft as set forth in Table 1, influence the average shot distance for each such wedge. The increase in shaft length from the 9-iron to the 3-iron is more substantial than the increase in the shaft lengths of the wedges. As such, the increase shaft lengths in this respect result in respective increases in club head speed and hence greater ball speed and distances. It should be appreciated that such shaft lengths and their overall progression from club to club are unique. For instance, the shaft length of the 3-iron is about three-fourths of an inch longer than the typical 3-iron. The average golfer has more difficulty hitting longer irons, such as a 3-iron or 4-iron. As a result, the average golfer using a typical set may not hit the 3-iron or 4-iron as long as a 5-iron. However, in the embodiment set forth in Table 1, the longer shaft lengths of the irons, such as the 3- and 4-irons, alone and in conjunction with other parameters as set forth herein, result in greater club head and ball speed than in typical golf sets. Thus, in this way, the average golfer may consistently hit the 3-iron farther than the 4-iron and the 4-iron farther than the 5-iron, for instance.

Another parameter contributing to overall greater gap distance in the set, and greater ball speed and distance for each individual iron, is face thickness. A thinner face thickness provides a higher coefficient of restitution (COR). It should be understood that a higher COR generally correlates to a greater launch speed of a golf ball upon impact with the club face, and hence greater ball flight distance. As set forth in one embodiment reflected in Table 1, the face thickness is basically consistent from the SW to the 8-iron or about 2.5 mm. The face thickness substantially decreases from the 8-iron to the 3-iron, or from about 2.5 mm to about 1.9 mm. Specifically, as set forth in Table 1, the face thickness of the 6- and 7-irons is about 2.2 mm, and the face thickness of the 3-, 4- and 5-irons is about 1.9 mm. This unique progression of thinner face thicknesses increases the COR of the clubs in the longer irons, alone and in conjunction with other parameters as set forth herein.

Thinner face thicknesses also allow more weight to be distributed along the perimeter of the club face and/or lower and farther back from the face of the club, thereby providing for higher moments of inertia (MOI) and more forgiving "sweet spot" areas. This allows the face area to be increased while not increasing or significantly increasing the club's weight or swing weight. As reflected in Table 1, the face area of the 3-iron through the 9-iron is substantially the same, and is above about 3100 $mm^2$, or preferably from about 3152 $mm^2$ to about 3150 $mm^2$. The face area of the PW is also substantially the same at about 3166 $mm^2$. Typically, the face area of the 3-iron is smaller than that of a PW by about 300 $mm^2$ or more, but that is not the case in the embodiment reflected in Table 1. And the face areas of the AW and SW are about 3207 $mm^2$ and about 3348 $mm^2$, respectively.

Thus, the larger faces of the clubs, especially in conjunction with thinner faces, provide for increased COR (or "trampoline" effect) and "sweet spot" areas. In other words, the clubs are more forgiving if the ball is not struck in the center of the face or at the ideal spot since the larger face area in turn provides for a larger area for the ball to be struck and still achieve satisfactory trajectory, speed and flight distance. As shown in Table 1, the COR can be above 0.800. The COR figures set forth herein are measured first by impacting the iron with a ball travelling at 133 ft/sec (per USGA protocol for irons) and measuring the COR. A ball is then impacted with a calibration plate at 133 ft/sec and the COR is measured. (The calibration plate is calibrated to represent a COR of 830 for a driver when impacted with a ball travelling at 160 ft/sec.) The difference in COR values between the ball impacting the iron at 133 ft/sec and the calibration plate at the same speed is calculated. That numerical value is then used to estimate the COR for a ball strike on the iron at 160 ft/sec (taking into account the COR is 830 for the calibration plate at that speed), and that estimate is recorded as the COR value of the irons as reflected herein.

As reflected in Table 1, the topline thickness progression of the clubs increases substantially from the SW to the 3-iron. In particular, the topline thicknesses of the wedges and short irons (or SW, AW, PW, and 8-, 9-irons) range from about 7.5 to about 7.7 mm. The topline thickness of the middle irons (or the 6- and 7-irons) is about 8.5 mm. The topline thicknesses of the long irons (or the 3-, 4-, 5-irons) are from about 9.3 to about 9.4 mm. It is believed that a thinner topline visually makes a club appear more difficult to hit or requires more precision in striking the ball. Thus, the increased topline thicknesses of the long and/or middle irons give the appearance that these clubs are easier to hit than such clubs having thinner topline thicknesses. Golfers typically have more difficulty hitting longer and middle irons than shorter irons or wedges. Thus, thicker topline thicknesses on long and/or middle irons build a golfer's confidence that he or she can properly or effectively hit such irons with success. The wedges and short irons have thinner topline thicknesses since these clubs typically are easier to hit than long and/or middle irons, and golfers tend to hit them with more precision than the other irons Likewise, the thinner toplines of the shorter irons and wedges also give the player more confidence that she or he can hit such irons with the precision often required of them. (It should be appreciated of course that precision is also often required by middle and long irons.)

As shown in Table 1, the swing weight of the irons is essentially consistent from club to club. Consistent swing weight contributes to a consistent feel for the golfer to the extent possible from club-to-club. A consistent feel and balance of the clubs increases the likelihood that the golfer will produce a consistent and repeatable swing, and thus gain confidence, independent of the club selected for a particular shot.

Another unique feature of one embodiment of the golf club set when considered individually and in conjunction with the other parameters is the width of the soles, both at the toe and heel of each club head. Specifically, the parameters discussed herein allow for more weight to be distributed lower and farther back in the club head relative to the face of the club. This allows for increased launch angles, thereby launching golf balls higher more quickly and faster and increasing overall peak trajectory and distance. Traditional club sets generally progress in sole widths (especially at the toes) from the long irons to the wedges, with the long irons particularly having much thinner soles. As reflected in Table 1, the longer irons, such as the 3-, 4-, and 5-irons, have relatively wide sole widths at the toes that allow (among other things) more weigh to be distributed lower and farther back in the club head. The long irons are relatively wider in this respect compared to the other irons in the set. As with the long irons, the other clubs in the set have unique sole widths to also provide the performance characteristics mentioned above. It should be understood that shorter irons and wedges in particular have higher loft angles so wider sole widths are somewhat secondary factors in achieving increased launch angles. As set forth in Table 1, the progression of loft degree of the clubs increases from the 3-iron through the SW. It should be appreciated that increased loft angle increases launch angle and the peak trajectory of the golf ball, and that the other parameters as discussed herein work in conjunction with the loft angles of the clubs to improve performance, playability and forgiveness.

In view of the many possible embodiments to which the principles of the disclosed embodiments may be applied, it should be recognized that the illustrated embodiments are only preferred examples and should not be taken as limiting the scope of the claimed subject matter. It will be evident that various modifications may be made thereto without departing from the broader spirit and scope set forth herein. The specification and drawings are, accordingly, to be regarded in an illustrative sense rather than a restrictive sense.

We claim:

1. A set of golf club irons, comprising:

at least three irons wherein the irons have face thicknesses that progress from about 1.9 mm for a longer iron in the set to about 2.5 mm for a shorter iron in the set, wherein the set has 3-, 4- and 5-irons with sole toe widths from about 25.5 mm to about 26.5 mm.

2. A set of golf club irons, comprising:

a 3-, 4-, 5-, 6-, 7-, 8- and 9-iron, wherein said irons each have a face area of substantially the same size and greater than about 3100 mm2 and wherein the 3-, 4-, and 5-irons each have a face thickness of about 1.9 mm, the 6-iron and 7-iron each have a face thickness of about 2.2 mm, and the 8-iron and 9-iron each have a face thickness of about 2.5 mm, wherein the 3-, 4-, and 5-irons each have a topline thickness of at least about 9.3 mm.

3. A set of golf club irons, comprising:

a 3-, 4-, 5-, 6-, 7-, 8- and 9-iron, wherein said irons each have a face area of substantially the same size and greater than about 3100 mm2 and wherein the 3-, 4-, and 5-irons each have a face thickness of about 1.9 mm, the 6-iron and 7-iron each have a face thickness of about 2.2 mm, and the 8-iron and 9-iron each have a face thickness of about 2.5 mm, wherein the 3-iron has a topline thickness of about 9.4 mm, the 4-iron has a topline thickness of about 9.3 mm, and the 5-iron has a topline thickness of about 9.4 mm.

4. A set of golf club irons, comprising:

a 3-, 4-, 5-, 6-, 7-, 8- and 9-iron, wherein said irons each have a face area of substantially the same size and greater than about 3100 mm2 and wherein the 3-, 4-, and 5-irons each have a face thickness of about 1.9 mm, the 6-iron and 7-iron each have a face thickness of about 2.2 mm, and the 8-iron and 9-iron each have a face thickness of about 2.5 mm, wherein the 3-, 4-, and 5-irons each have a sole toe width of about 25.5 mm to about 26.5 mm.

* * * * *